US010364981B2

(12) United States Patent
Wang et al.

(10) Patent No.: US 10,364,981 B2
(45) Date of Patent: Jul. 30, 2019

(54) METHOD FOR DECREASING NITROGEN OXIDES OF A PULVERIZED COAL BOILER USING BURNERS OF INTERNAL COMBUSTION TYPE

(75) Inventors: Yupeng Wang, Shandong (CN); Hong Tang, Shandong (CN); Yuwang Miao, Shandong (CN); Tao Niu, Shandong (CN); Huaijun Ma, Shandong (CN); Peng Liu, Shandong (CN); Xinguang Wang, Shandong (CN); Xiaoyong Zhang, Shandong (CN); Yubin Zhang, Shandong (CN); Chaoqun Zhang, Shandong (CN); Yongsheng Dong, Shandong (CN); Xingyuan Cui, Shandong (CN)

(73) Assignee: YANTAI LONGYUAN POWER TECHNOLOGY CO., LTD., Yantai, Shandong (CN)

( * ) Notice: Subject to any disclaimer, the term of this patent is extended or adjusted under 35 U.S.C. 154(b) by 1399 days.

(21) Appl. No.: 12/921,658

(22) PCT Filed: Jun. 18, 2008

(86) PCT No.: PCT/CN2008/001179
§ 371 (c)(1),
(2), (4) Date: Sep. 9, 2010

(87) PCT Pub. No.: WO2009/111912
PCT Pub. Date: Sep. 17, 2009

(65) Prior Publication Data

US 2011/0033807 A1 Feb. 10, 2011

(30) Foreign Application Priority Data

Mar. 14, 2008 (CN) ..... 2008 1 0085042

(51) Int. Cl.
*F23D 1/00* (2006.01)
*F23C 5/08* (2006.01)
*F23C 6/04* (2006.01)

(52) U.S. Cl.
CPC ..... *F23D 1/00* (2013.01); *F23C 5/08* (2013.01); *F23C 6/04* (2013.01);
(Continued)

(58) Field of Classification Search
CPC ..... F23D 1/00; F23D 2201/00; F23C 5/08; F23C 2201/20; F23Q 13/00; H05H 1/26; H05H 1/42; H05H 1/48
(Continued)

(56) References Cited

U.S. PATENT DOCUMENTS 4,654,001 A * 3/1987 LaRue ..... F23D 1/00 110/263
4,907,962 A 3/1990 Azuhata et al.
(Continued)

FOREIGN PATENT DOCUMENTS

CN 2521510 Y 11/2002
CN 2632502 Y 8/2004
(Continued)

OTHER PUBLICATIONS

Extended European Search Report dated May 12, 2014; Appln. No. EP 08 75 7456.

*Primary Examiner* — Kenneth Rinehart
*Assistant Examiner* — Logan P Jones
(74) *Attorney, Agent, or Firm* — Ladas & Parry LLP

(57) ABSTRACT

A method for decreasing nitrogen oxides of a pulverized coal boiler using burners of internal combustion type including during the operation of the boiler, ignition sources in the burners of internal combustion type mounted on side walls of the boiler are always in a working state, and igniting the
(Continued)

pulverized coal in the burners in advance; decreasing secondary air amount in a primary combustion zone of the boiler so that the primary combustion zone is in a relatively strong reducing atmosphere and an oxygen-deficient condition for inhibiting generation of NOx is created; and supplying remaining air from an upper part of a furnace of the boiler in a form of over-fire air, so that a deep air staging is carried out in the total furnace. Thus, the NOx generation of combustion can be effectively controlled on the premise of not decreasing efficiency of the boiler.

3 Claims, 3 Drawing Sheets

(52) U.S. Cl.
CPC ..... *F23C 2201/101* (2013.01); *F23C 2900/03005* (2013.01); *F23D 2201/10* (2013.01); *F23D 2201/20* (2013.01)

(58) Field of Classification Search
USPC ..... 431/10; 110/341, 345, 347; 361/247
See application file for complete search history.

(56) References Cited

U.S. PATENT DOCUMENTS

| | | | | | |
|---|---|---|---|---|---|
| 5,156,100 | A * | 10/1992 | Pentti | 110/347 | |
| 5,623,884 | A * | 4/1997 | Penterson | F23C 5/00 110/234 | |
| 6,699,031 | B2 * | 3/2004 | Kobayashi et al. | 431/10 | |
| 6,790,032 | B1 * | 9/2004 | Wu | F23C 6/04 110/234 | |
| 2004/0114300 | A1 * | 6/2004 | Wang | F23D 1/00 361/247 | |
| 2006/0115779 | A1 | 6/2006 | Yamamoto et al. | | |
| 2006/0191451 | A1 * | 8/2006 | Jia et al. | 110/345 | |

FOREIGN PATENT DOCUMENTS

| | | | | | |
|---|---|---|---|---|---|
| CN | 1786564 | A | | 6/2006 | |
| CN | 2886352 | Y | | 4/2007 | |
| JP | 63-267806 | A | | 11/1988 | |
| JP | 06265109 | A | * | 9/1994 | |
| RU | 2171429 | C1 | * | 7/2001 | |
| WO | WO 2007131392 | A1 | * | 11/2007 | F23D 1/00 |

* cited by examiner

METHOD FOR DECREASING NITROGEN OXIDES OF A PULVERIZED COAL BOILER USING BURNERS OF INTERNAL COMBUSTION TYPE

TECHNICAL FIELD

The present invention relates to a combustion technique of decreasing nitrogen oxides, and more specifically, to a combustion technique of decreasing nitrogen oxides of a pulverized coal boiler using burners of internal combustion type.

DESCRIPTION OF THE RELATED ART

Nitrogen oxides (mainly includes NO, $NO_2$, $N_2O$, $N_2O_3$, $N_2O_4$, $N_2O_5$ etc., a general designation of NOx) seriously endanger the living environment of the human beings and human beings per se, on one hand, NOx is a main factor of forming acid rain; on the other hand, NOx can form photochemical smog with hydrocarbon in a certain condition to destroy the environment of the atmosphere, hazard the health of human beings seriously and deteriorate the environments the human beings depend on. With the rapid development of the industry of our country, people pay much more attention to the pollution problem of NOx.

One of the main discharge sources of NOx is the coal-fired utility boiler. Based on the statistics, in 2002, the discharge amount of nitrogen oxides of our country is about 11.77 million tons, where about 63% of the discharge is from coal-firing. Therefore, in order to protect environment, decreasing of the discharge amount of NOx of the utility boiler is necessary.

The method of decreasing pollution discharge of NOx of the utility boiler is divided into two classes: low NOx combustion technique in the furnace (inhibiting the generation of NOx in the furnace) and flue gas denitrification technique (reducing the generated NOx in the boiler back-end ductwork). The flue gas denitrification technique needs vast invest at the beginning, high running costs, and big occupied area for which some units at work cannot satisfy the demand of space. Therefore, low NOx combustion technique is mostly adopted in our country at present to decrease the discharge of nitrogen oxides.

NOx generated by coal-fired boiler is mainly fuel NOx generated by N element in the pulverized coal (about 75%~90%) and thermal NOx generated by reacting $N_2$ in air due to high temperature combustion (about 10%~25%). The main factors of affecting the generation amount of NOx during pulverized coal combustion are combustion temperature, excess air coefficient, nitrogen content in the fuel and fuel residence time. Therefore, the main ways to control the generation of NOx are: (1) decreasing the level of combustion temperature to protect from generating local high temperature zone; (2) decreasing the oxygen concentration of the primary combustion zone, so that the combustion proceeds in a condition deviating from the theoretical quantity of combustion air; and (3) organizing the burning airflow properly, so that NOx is reduced in the flame.

The pulverized coal burners designed by the current boiler factories normally are of external burning type. During normal operation, the ignition temperature of the pulverized coal is achieved in the furnace, and the pulverized coal directly sprayed into the furnace through the burner is ignited and burnt progressively under the action of convection heat of high temperature circumfluence flue gas and radiation heat of the flame in the furnace, and is burnt-out in the upper of furnace. When the boiler works in this conventional combustion manner, very high temperature and high oxygen concentration must be assured in the primary combustion zone of the boiler to reach the purpose of ignition and stabilized combustion, and thus the generation amount of NOx in the primary combustion zone is very big.

At present, the low NOx combustion techniques adopted by the utility boiler are as follows: air staged combustion technique, fuel staged combustion technique, intensifying combustion by igniting in advance and re-burning technique, etc. However, when the above techniques are applied to the boiler installed with burners of the conventional external combustion type, air distribution has to be considered after the pulverized coal is sprayed into the furnace, to satisfy demands of the ignition, stabilized combustion and burnt-out of the pulverized coal, and combustion reaction can not be deviated from stoichiometric ratio during operation, and thus the degrees of fuel staging and air staging are limited, the effect of decreasing NOx discharge is limited too. Moreover, the applications of such techniques usually affect the combustion organization in the furnace, so that combustion efficiency of the boiler is affected to a certain extent.

Therefore, a high efficiency and low NOx combustion technique without affecting stabilized combustion and combustion efficiency is needed for the pulverized coal utility boiler in urgency to satisfy demands of decreasing NOx discharge.

SUMMARY OF THE INVENTION

The present invention aims to provide a method for decreasing nitrogen oxides of a pulverized coal boiler using burners of internal combustion type to solve the combustion technical problem of decreasing NOx without decreasing stabilized combustion ability and the combustion efficiency of the boiler.

The purpose of the present invention is achieved as follows: the method according to the present invention comprises: all or part of the pulverized coal burners mounted on the side wall(s) of the boiler work in an internal combustion manner, that is, during the whole operation of the boiler, ignition sources in the burners of internal combustion type keep in a working state; under the condition that the pulverized coal fuel is already ignited when being sprayed from the burners, the secondary air to be supplied into a primary combustion zone of the boiler is decreased, so a strong reducing atmosphere is formed in the primary combustion zone so that the pulverized coal fuel is burnt in a high temperature and oxygen-deficient state; and the remaining air is supplied, in the upper of the furnace of the boiler, into the furnace in the form of over-fire air, forming an area of strong oxidizing atmosphere, so that the incompletely burnt pulverized coal in the primary combustion zone of the boiler is mixed intensively with air in this area and is reacted fully to meet the need of burning-out of the pulverized coal.

In the method for decreasing nitrogen oxides of a pulverized coal boiler using burners of internal combustion type, for each burner of internal combustion type, it is interiorly divided into several stages of combustion chambers, a dense/thin separation is done for the primary air and pulverized coal flow in the burner, wherein denser pulverized coal enters the central chamber and thinner pulverized coal enters the remaining combustion chambers, so that the air and the pulverized coal flow in the central chamber is concentrated to a denseness level suitable for ignition; denser pulverized coal in the central chamber of the burner is ignited firstly by the ignition sources, then the remaining thinner pulverized coal is ignited by the heat emitted by the igniting and burning of the ignited pulverized coal, the pulverized coal is burnt in the burner stage by stage.

In the method for decreasing nitrogen oxides of a pulverized coal boiler burners of internal combustion type, for each burner of internal combustion type, the pulverized coal fuel is ignited in advance in the central chamber of the burner by the ignition source, and the ignition intensity of the pulverized coal in the burner can be adjusted by changing the energy of the ignition source to achieve the effects of decreasing the generation of nitrogen oxides.

In the method for decreasing nitrogen oxides of a pulverized coal boiler using burners of internal combustion type, for each burner of internal combustion type, a plasma generators or a small oil gun is adopted as the ignition source; the burner are designed as straight flow burner or swirl burner; and the boiler is tangentially-fired or wall-fired.

In the method for decreasing nitrogen oxides of a pulverized coal boiler using burners of internal combustion type, for each burner of internal combustion type, only the primary air in the burner supplies the oxygen amount necessary for the pulverized coal combustion, the excess air coefficient thereof is lower than 0.4.

In the method for decreasing nitrogen oxides of a pulverized coal boiler using burners of internal combustion type, the amount of the secondary air is decreased in the primary combustion zone, the excess air coefficient in the primary combustion zone maintains about 0.85 when the boiler uses the plasma ignition burners to make the fuel in a oxygen-deficient combustion state for a long time, and the excess air coefficient in the primary combustion zone is about 0.85~0.95 when the boiler uses conventional burners, The advantageous effects of the present invention are embodied in that during the operation of the boiler, the ignition sources of the burners are in use all the time, that is, in a form of internal combustion, so that the fuel entering the furnace is already in a ignited state, and the output power of the plasma generator or the output of the ignition sources such as the small oil gun can be changed to adjust the ignition level of the pulverized coal in the burner. Only the primary air in the burner supplies oxygen, the excess air coefficient is very low, the strong formed reducing combustion environment can decrease the generation of NOx effectively. Since, after the fuel is sprayed into the furnace, the ignition problem has been solved, only a certain amount of air is needed to ensure stabilized combustion, the whole air distribution in the furnace can be adjusted in a greater range, and the excess air coefficient in the primary combustion zone can be controlled in a very low level. Thus, a very strong reducing atmosphere inside the burner and the primary combustion zone is formed. It is advantageous for inhibiting the generation of NOx during pulverized coal combustion. In order to ensure the final burnt-out rate of the pulverized coal, the remaining air is supplied in the form of the over-fire air from the upper of the furnace, an area of strong oxidizing atmosphere is formed in which air is mixed intensively with the incompletely burnt pulverized coal in the primary combustion zone of the boiler and is reacted sufficiently, so that the combustion efficiency of the boiler is not decreased. Thus, a deep air staging is formed in the whole furnace.

The pulverized coal can be ignited to burn before entering the furnace in the burner of internal combustion type, the burner having the features of deep air staging and fuel staging makes the C-element in the fuel start to react in a great deal in the high temperature and low oxygen condition before it can mix with enough air, and the main products are CO. In this atmosphere, N element in the volatile constituent tends to be converted to reducing substances such as HCN, NHi etc., which not only decreases the generation of NOx, but also largely reduces the generated NOx in the flame ($HCN+NOx \rightarrow N_2+H_2O+CO$, $NHi+NOx \rightarrow N_2+H_2O$), and decreases the generation of fuel NOx finally. Meanwhile, since the excess air coefficient in the primary combustion zone is very low, pulverized coal is not completely burnt and the temperature is limited, the generation of thermal NOx is controlled. In the burnt-out zone, though the incompletely burnt fuel obtains enough oxygen to fully react, the generation of NOx is not big due to the low temperature of the mixed-in air, and thus the whole generation amount of NOx is effectively controlled.

Meanwhile, since the burner of internal combustion type is used, the pulverized coal starts to be fired and react before entering the furnace, the ignition in advance equals to enlarge the combustion space of the furnace, and an advantageous condition is provided for improving the burnt-out rate of fuel, which overcomes the defects of most of conventional low NOx combustion technique that render the decreasing of the boiler combustion efficiency.

Above all, the present invention can effectively inhibit the generation amount of NOx during the combustion of the pulverized coal and achieve reduced pollution discharge of NOx on the premise of not decreasing the boiler efficiency. The costs of pollution discharge due to the discharge of NOx can not only be saved for power station to bring great economic benefits, but also great social benefits due to the high efficient and environmental protection thereof can be brought about.

DETAILED DESCRIPTION OF THE PREFERRED EMBODIMENT

The specific embodiments of the present invention will be described according to the following figures.

Figure 2:
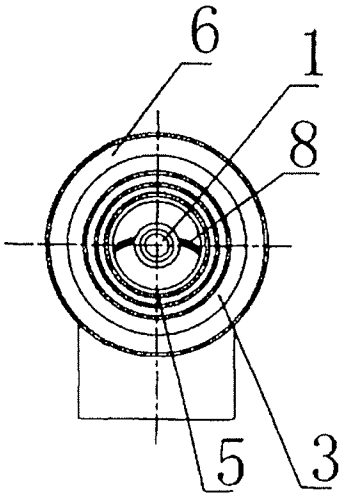
FIG. 2 is the left view of FIG. 1.
Figure 1:
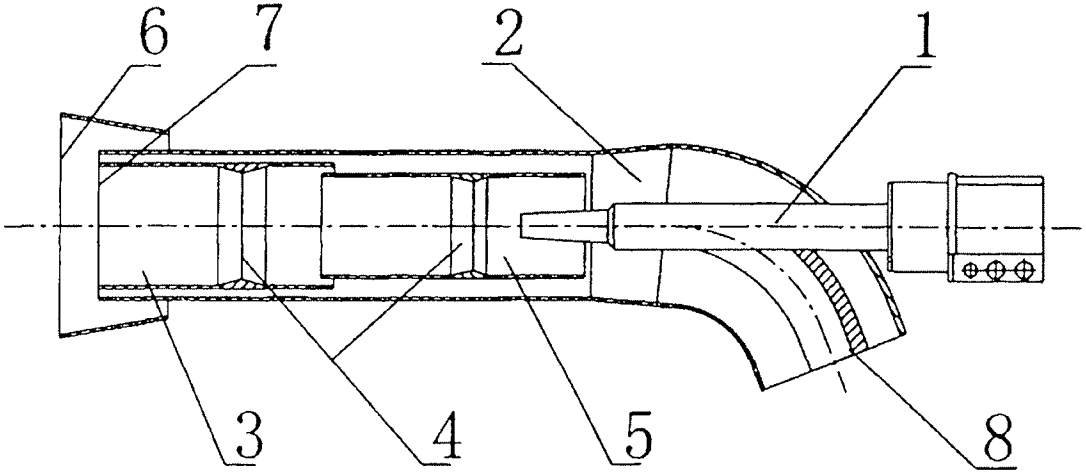
FIG. 1 is a schematic view of the structure of pulverized coal burner of internal combustion type in which a plasma generator is used as an ignition source according to the present invention.

FIG. 1 is a schematic view of the structure of a pulverized coal burner of internal combustion type in which a plasma generator is used as an ignition source according to the present invention. As shown in FIG. 1, the burner is divided interiorly into several stages, a bent plate 8 is provided at the elbow of the burner, dense/thin separation of the primary air and pulverized coal flow is generated at the bent plate 8 due to the different inertias between the pulverized coal and air. Denser pulverized coal enters the central chamber 5 of the burner, and the remaining thinner pulverized coal enters respective combustion chamber successively stage by stage. Then the pulverized coal is sprayed into the furnace from a primary air and pulverized coal nozzle 7 of the burner. The pulverized coal in the respective stages of the chambers of burner can be further concentrated through a pulverized coal concentrator 4, so that an air flow of the pulverized coal with denseness in the center and thinness in the surrounding in the radial direction of the burner 2. Thus, a deep fuel staging is formed in the burner 2. Firstly, the dense pulverized coal in the central chamber is fast ignited by the ignite device, and the emitted heat after firing ignites the remaining thinner pulverized coal in the burner stage by stage, so the deep fuel staging is achieved and the fuel is sprayed into the furnace for combustion at the same time.

The plasma generator 1 generates a plasma arc with high temperature and high enthalpy value after starting, which acts on highly concentrated pulverized coal in the central chamber 5 of the burner, causing the pulverized coal particles to burst fast and release volatile constituents, and start to be ignited. A great amount of heat is released from the ignited pulverized coal in the central chamber 5, and this heat further ignites the remaining thinner pulverized coal in the burner 2. During operation, the plasma generator 1 keeps in a working state, that is, makes sure that the pulverized coal is ignited when entering the central chamber 5, all or most of the pulverized coal already starts to be ignited when it is sprayed into the furnace from the nozzle 7 of the burner. The output power of the plasma generator 1 can be adjusted: increasing power can make the amount of the pulverized coal ignited in advance increase to control the ignition degree of the pulverized coal in the burner.

Only the primary air in the burner provides the oxide amount necessary for the combustion of the pulverized coal, the excess air coefficient thereof is lower than 0.4, which is significantly lower than the oxide concentration during the normal ignition of the pulverized coal, and the strong formed reducing combustion environment can effectively decrease the generation of NOx. After the fuel is sprayed into the furnace, since the problems of ignition and stabilized combustion of the pulverized coal have been solved, the time of mixing of the pulverized coal with the secondary air can be deferred properly, the secondary air amount of the primary combustion zone can be decreased, and the excess air coefficient can be maintained at 0.85 or less (the excess air coefficient of the primary combustion zone of the boiler using conventional burners is about 0.85~0.95), which makes the fuel is in an oxygen-deficient burning state for a long time. Thus, a strong reducing atmosphere is formed inside the burner and in the primary combustion zone, which is beneficial for inhibiting the generation of NOx during combustion process of the pulverized coal.

Embodiment 1

Figure 3:
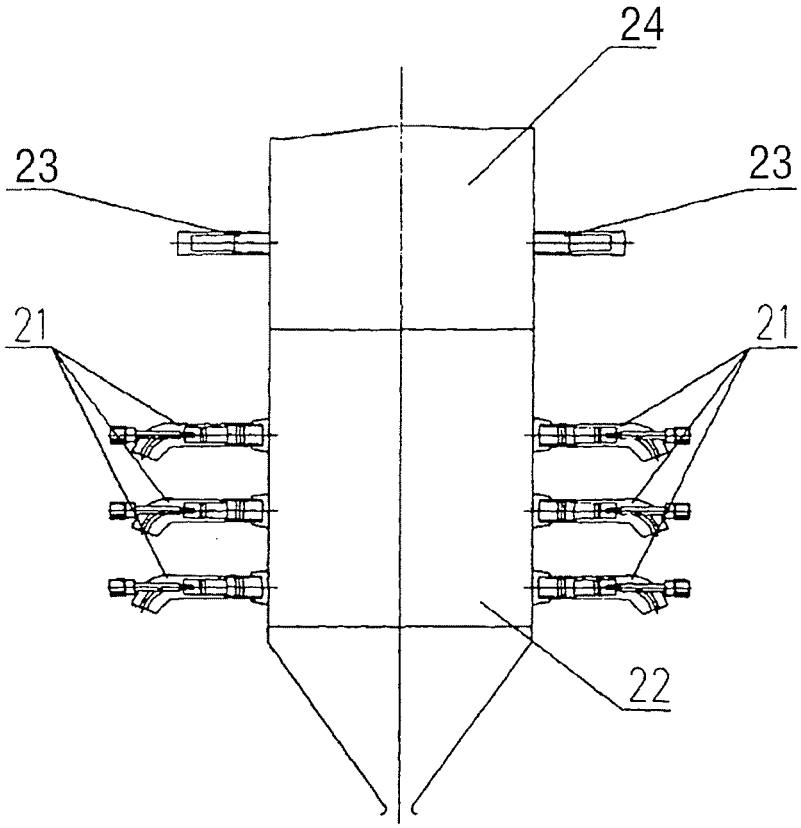
FIG. 3 is a schematic view of a wall-fired pulverized coal boiler in which swirl burners of internal combustion type are applied according to the present invention.
Figure 4:
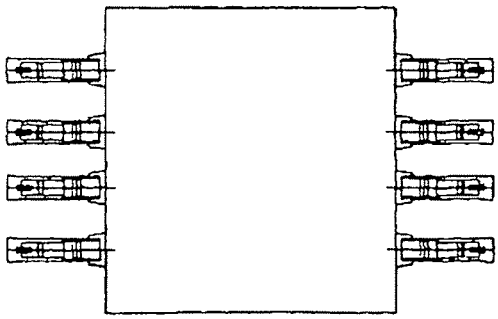
FIG. 4 is a schematic section view of the pulverized coal burner of FIG. 3.

FIGS. 3 and 4 are schematic views of a specific embodiment of a wall-fired pulverized coal boiler in which swirl burners of internal combustion type are applied, in which burners plasma generators are used as the ignition sources. As shown in FIGS. 3 and 4, all of the burners of the boiler are designed or retrofitted as the burners of internal combustion type 21 in which the plasma generators are used as the ignition sources. During the operation of the boiler, the plasma generators 1 show in FIG. 1 keep in a working state, cause the pulverized coal to be ignited stage by stage in the burners 21, the primary air and pulverized coal nozzle 7 of the burner is connected with the primary combustion zone 22 of the furnace, so that all or most of the pulverized coal sprayed into the primary combustion zone 22 of the furnace is in a igniting state. The air amount entering the primary combustion zone 22 from the secondary air nozzle 6 of the burners is controlled so that the oxygen concentration in the primary combustion zone 22 is decreased; the strong reducing atmosphere which is beneficial for inhibiting the generation of NOx is formed. Under the condition of high temperature and oxygen-deficient state, C element in the fuel starts to react in a great deal before it can mix with enough air, and the main products are CO. In a high concentration CO atmosphere, N element in the volatile constituents tends to be converted to reducing substances such as HCN, NHi etc., so that not only the generation of NOx is decreased, but also the generated NOx can be largely reduced in the flame ($HCN+NOx \rightarrow N_2+H_2O+CO$, $NHi+NOx \rightarrow N_2+H_2O$), and the fuel generation of NOx is decreased finally. Meanwhile, since the excess air coefficient in the primary combustion zone 22 is very low, the pulverized coal is not fully burnt, the temperature is limited, and thus generation of the thermal NOx is controlled.

The remaining air is sprayed into the burnt-out zone 24 of the furnace through the over-fire air nozzle 23 of the upper furnace, and is mixed with the incompletely burnt flue gas coming from the primary combustion zone 22 intensively, and thus a very strong oxidation atmosphere is formed so that the pulverized coal particles in the flue gas are burnt out herein. Since a large amount of low temperature air is sprayed in from the burnt-out air nozzle 23, the temperature in the burnt-out zone 24 of the furnace is not very high, so the amount of NOx generated from the full reaction of pulverized coal is limited. Thus, the generation amount of NOx is decreased without affecting the efficiency of the boiler.

Embodiment 2

Figure 5:
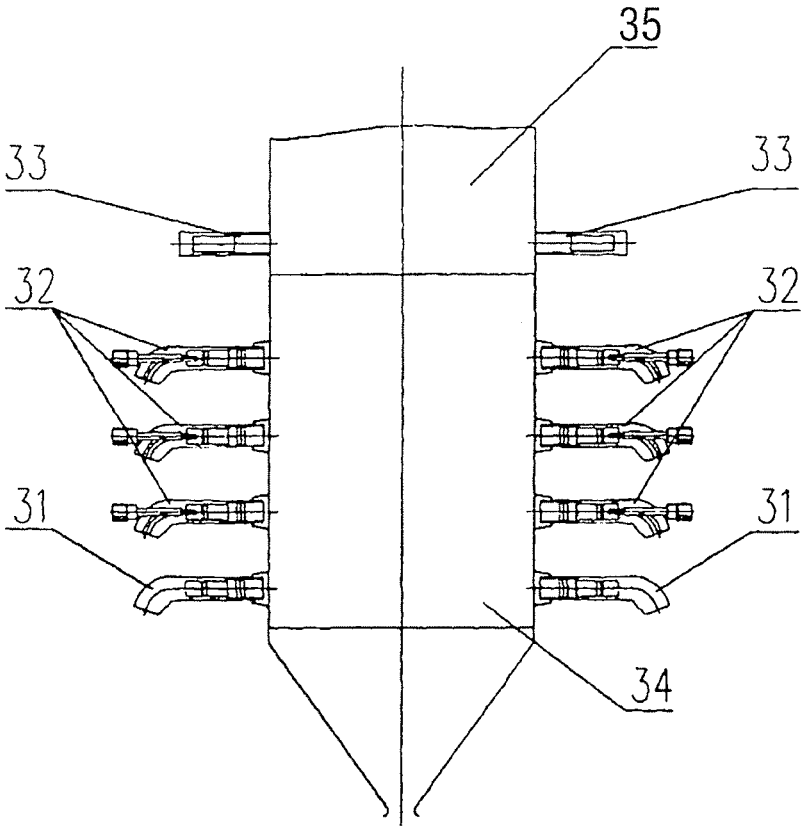
FIG. 5 is a schematic view of a tangentially-fired pulverized coal boiler in which straight flow burners of internal combustion type are applied according to the present invention.
Figure 6:
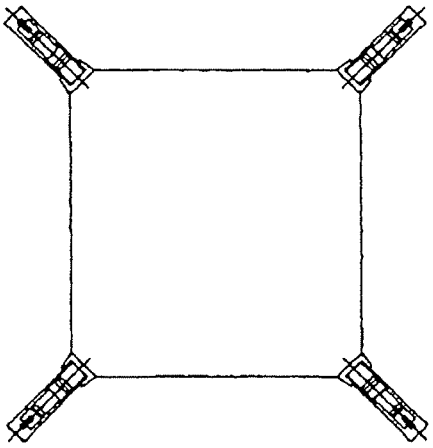
FIG. 6 is a schematic section view of the pulverized coal burner of FIG. 5.

FIGS. 5 and 6 are schematic views of a specific embodiment of a tangentially-fired pulverized coal boiler in which straight flow burners of internal combustion type are applied, in which burners plasma generators are used as ignition sources. As shown in FIGS. 5 and 6, the upper three layers of the four layer burners of the boiler are designed or retrofitted as the burners of internal combustion type 32 in which the plasma generators are used as the ignition sources, the lowest layer of burners are still conventional straight flow burners 31.

During the operation of the boiler, the conventional straight flow burners 31 still keep in a normal running state, and a large amount of NOx is generated in the lower of the primary combustion zone 34 of the furnace. The plasma generators 1 shown in FIG. 1 keep in a working state, causing the pulverized coal to be ignited stage by stage in the burner 32. The primary air and pulverized coal nozzle 7 of the burner is connected with the primary combustion zone 34 of the furnace, and thus all or most of the pulverized coal sprayed into the primary combustion zone 34 of the furnace is in an igniting state. The air amount entering the primary combustion zone 34 from the secondary air nozzle 6 of the internal combustion burner 31 is controlled, so that the oxygen concentration in the upper space of the primary combustion zone 32 is decreased, a strong reducing atmosphere which is beneficial for inhibiting the generation of NOx is formed.

Under the condition of high temperature and oxygen-deficient state, C element in the fuel starts to react in a great deal before it can mix with enough air, and the main products are CO. In a high concentration CO atmosphere, N element in the volatile constituent tends to be converted to reducing substances such as HCN, NHi etc., so that not only the generation amount of NOx is decreased, but also the NOx which is produced in the lower space of the primary combustion zone 34 of the furnace is largely reduced in the flame ($HCN+NOx \rightarrow N_2+H_2O+CO$, $NHi+NOx \rightarrow N_2+H_2O$), and the generation of fuel NOx is decreased finally. Meanwhile, since the excess air coefficient in the upper of the primary combustion zone 34 is very low, the pulverized coal is not fully burnt, the temperature is limited, and the generation of thermal NOx is controlled.

The remaining air is sprayed into the burnt-out zone 35 of the furnace through the over-fire air nozzle 33 in the upper of the furnace, and is mixed intensively with the incompletely burnt flue gas coming from the primary combustion zone 34, a very strong oxidation atmosphere is formed, so that the pulverized coal particles in the flue gas are burnt out herein. Since a large amount of low temperature air is sprayed in from the over-fire air nozzle 33, the temperature level in the burnt-out zone 35 of the furnace is not very high, the amount of NOx generated from the full reaction of the pulverized coal is limited, so that the total generation amount of NOx is effectively controlled. Thus, the generation amount of NOx is decreased without affecting the efficiency of the boiler.

The invention claimed is:

1. A method for decreasing nitrogen oxides of a pulverized coal boiler using internal combustion type burners, the method consisting of:

keeping ignition sources in the internal combustion type burners mounted on side walls of the boiler in a working state when operating the boiler;

igniting pulverized coal in the internal combustion type burners by using the ignition sources;

spraying ignited pulverized coal from the internal combustion type burners, into a furnace of the boiler, deferring the time of mixing of the pulverized coal with secondary air, decreasing an amount of secondary air supplied into a primary combustion zone of the boiler, under the condition that the pulverized coal is already ignited when being sprayed from the internal combustion type burners, to form a reducing atmosphere in the primary combustion zone so that the pulverized coal is burnt in an oxygen-deficient state; and supplying over-fire air from an upper part of the furnace of the boiler into the furnace to form an oxidizing atmosphere so as to burn out the pulverized coal which is incompletely burnt in the primary combustion zone of the boiler, wherein only primary air supplies the oxygen amount necessary for the pulverized coal combustion in the burners, such that the excess air coefficient in the burners is lower than 0.4, wherein the burners are interiorly divided into several stages of combustion chambers, and a bent plate is provided at the elbow of the burner, dense/thin separation of the primary air and pulverized coal flow is generated at the bent plate, denser pulverized coal enters the central chamber of the burner, and the remaining thinner pulverized coal enters respective combustion chamber successively stage by stage, and an air flow of the pulverized coal is formed with denseness in the center and thinness in the surrounding in the radial direction of the burner, and the bent plate is arranged near the outside radius of the elbow as a single layer in radial direction of the burner.

2. A method for decreasing nitrogen oxides of a pulverized coal boiler using internal combustion type burners, the method consisting of:

keeping ignition sources in the internal combustion type burners mounted on side walls of the boiler in a working state when operating the boiler;

igniting pulverized coal in the internal combustion type burners by using the ignition sources;

spraying ignited pulverized coal from the internal combustion type burners, into a furnace of the boiler, deferring the time of mixing of the pulverized coal with secondary air, decreasing an amount of secondary air supplied into a primary combustion zone of the boiler, under the condition that the pulverized coal is already ignited when being sprayed from the internal combustion type burners, to form a reducing atmosphere in the primary combustion zone so that the pulverized coal is burnt in an oxygen-deficient state; and supplying over-fire air from an upper part of the furnace of the boiler into the furnace to form an oxidizing atmosphere so as to burn out the pulverized coal which is incompletely burnt in the primary combustion zone of the boiler, adjusting an ignition intensity of the pulverized coal in the burner by changing an energy of the ignition source, which decreases an amount of generated nitrogen oxides, wherein only primary air supplies the oxygen amount necessary for the pulverized coal combustion in the burners, such that the excess air coefficient in the burners is lower than 0.4, wherein the burners are interiorly divided into several stages of combustion chambers, and a bent plate is provided at the elbow of the burner, dense/thin separation of the primary air and pulverized coal flow is generated at the bent plate, denser pulverized coal enters the central chamber of the burner, and the remaining thinner pulverized coal enters respective combustion chamber successively stage by stage, and an air flow of the pulverized coal is formed with denseness in the center and thinness in the surrounding in the radial direction of the burner, and the bent plate is arranged near the outside radius of the elbow as a single layer in radial direction of the burner.

3. The method of claim 1, wherein the burners are a plasma generator or an oil gun adapted as the ignition source; and the burners are straight flow burners or swirl burners; and the boiler is a tangentially-fired boiler or a wall-fired boiler.

* * * * *